United States Patent [19]

Esposito et al.

[11] 4,181,907

[45] Jan. 1, 1980

[54] ELECTRICAL SWITCH CONSTRUCTION HAVING ARMATURE LATCH

[75] Inventors: Felix F. Esposito; Roger P. Sepso, both of Stratford, Conn.

[73] Assignee: Robertshaw Controls Company, Richmond, Va.

[21] Appl. No.: 908,125

[22] Filed: May 22, 1978

[51] Int. Cl.[2] ..... H01H 9/20

[52] U.S. Cl. ..... 335/170; 335/253

[58] Field of Search ..... 335/167, 170, 171, 253, 335/254

[56] References Cited

U.S. PATENT DOCUMENTS 3,774,129 11/1973 Sugiyama ..... 335/167

*Primary Examiner*—George Harris

*Attorney, Agent, or Firm*—Candor, Candor & Tassone

[57] ABSTRACT

An electrical switch construction having a frame carrying a movable switch blade and a latch structure for latching the switch blade in one position when the latch structure is latched and for causing the switch blade to be in another position when the latch structure is unlatched, the latch structure comprising an armature movably carried by the frame and a cam movably carried by the frame and being operatively associated with the switch blade to hold the switch blade in the one position thereof when the cam is latched by the armature being in a latching position thereof and being moved to an unlatching position from the cam when the armature is actuated by an electromagnetic actuator. The armature comprises two members secured together, one of the members being formed of plastic material and having a hook end for latching with the cam and the other of the members being formed of metal to be magnetically attracted by the actuator.

12 Claims, 8 Drawing Figures

ELECTRICAL SWITCH CONSTRUCTION HAVING ARMATURE LATCH

BACKGROUND OF THE INVENTION

1. Field of the Invention

This invention relates to an improved electrical switch construction having armature latch means.

2. Prior Art Statement

It is well known that electrical switch constructions have been provided with each having a movable switch blade adapted to be latched in one position thereof and being permitted to move to another position thereof when the latch means is unlatched whereby the latch means must be manually or automatically reset back to the latched position thereof.

For example, see the following two items:

(1) U.S. Pat. No. 3,848,311 to Russell.

(2) The switch construction of FIGS. 1, 2 and 3 of the drawings of this application.

The electrical switch constructions of items (1) and (2) above each has a frame means carrying a movable switch blade and a latch means for latching the switch blade in one position when the latch means is latched and for causing the switch blade to be in another position when the latch means is unlatched.

The latch means of item (1) above comprises a bimetal operated latch member which when heated will move to the unlatched condition thereof.

The latch means of item (2) above comprises an armature movably carried by the frame means and a cam member carried by the frame means and being operatively associated with the switch blade to hold the switch blade in the one position thereof when the cam is latched by the armature being in a latching position thereof and being moved to an unlatching position from the cam when the armature is actuated by an electromagnetic actuator carried by the frame means.

SUMMARY OF THE INVENTION

It was found according to the teachings of this invention that the fabrication of the parts and the assembly of various parts of the electrical switch construction of item (2) above could be made more reliable and less costly while reducing the frictional resistance between the cam and the armature latching interface to allow the resulting electrical switch construction to operate under low voltage conditions as well as insure that the latch is engaged fully against the cam thereof.

Accordingly, it is a feature of this invention to provide an improved latch arrangement for the electrical switch construction, such as the switch construction of item (2) above or other electrical switch construction, as desired.

In particular, one embodiment of this invention provides an electrical switch construction having a frame means carrying a movable switch blade and a latch means for latching the switch blade in one position when the latch means is latched and for causing the switch blade to be in another position when the latch means is unlatched, the latch means comprising an armature movably carried by the frame means and a cam movably carried by the frame means and being operatively associated with the switch blade to hold the switch blade in the one position thereof when the cam is latched by the armature being in a latching position thereof and being moved to an unlatching position from the cam when the armature is actuated by an electromagnetic actuator carried by the frame means. The armature comprises two members secured together, one of the members being formed of a plastic material and having means for latching with the cam and the other of the members being formed of metallic material in order to be magnetically attracted by the actuator. The frame means has a tongue passing through a slot in the armature to thereby pivotally mount the armature to the frame means intermediate to the opposed ends thereof. A compression spring is disposed between one of the ends of the armature and the frame means to provide a force tending to move the armature to the latching position thereof.

Accordingly, it is an object of this invention to provide an improved electrical switch construction having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
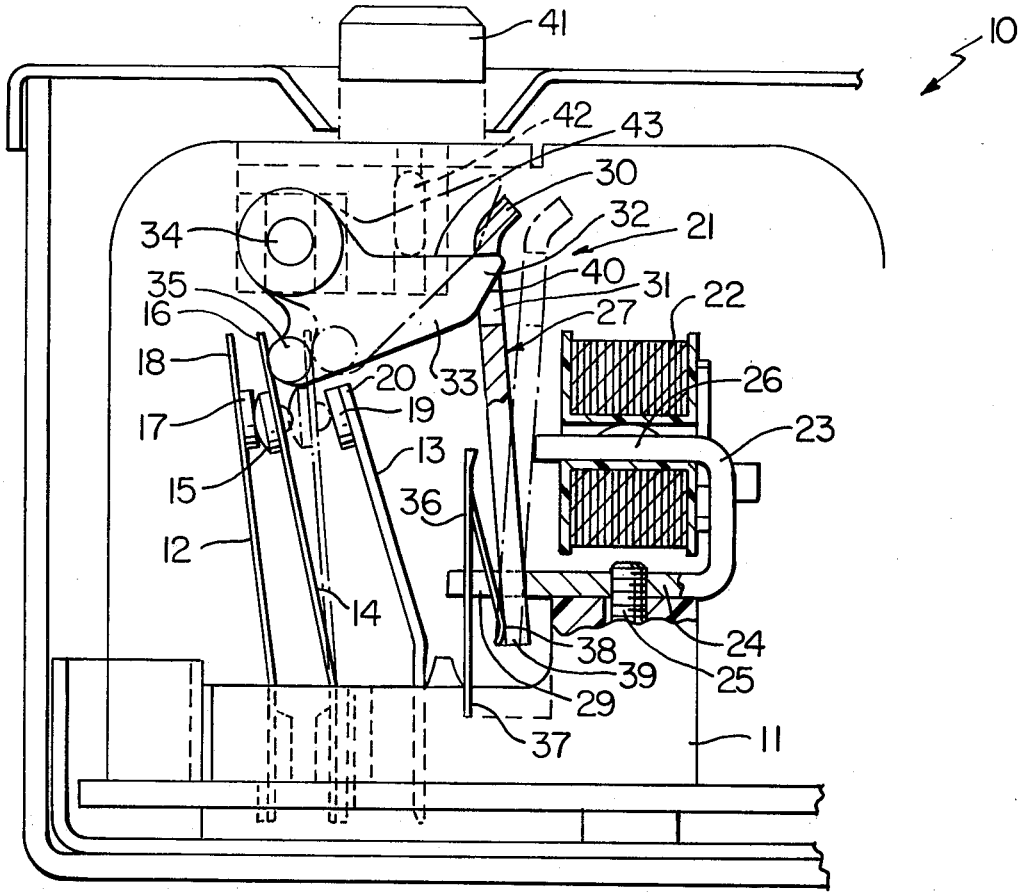
FIG. 1 PRIOR ART
FIG. 1 is a fragmentary side view of a prior art electrical switch construction.

While the various features of this invention are hereinafter described and illustrated as being particularly adapted to provide a manually resettable electrical switch construction, it is to be understood that the various features of this invention can be utilized singly or in any combination thereof to provide latch means for other types of electrical switch constructions as desired.

Therefore, this invention is not limited to only the embodiment illustrated in the drawings, because the drawings are merely utilized to illustrate one of the wide variety of uses of this invention.

Figure 2:
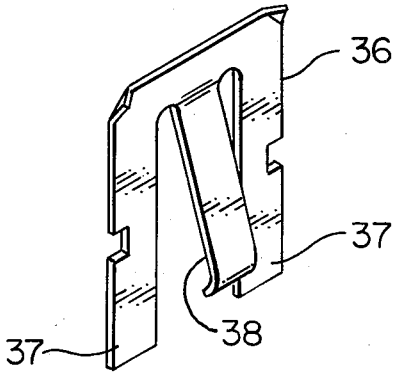
FIG. 2 is a perspective view of the spring member of the prior art electrical switch construction of FIG. 1.
Figure 3:
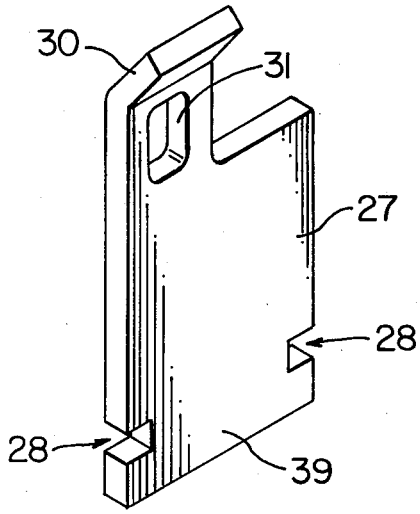
FIG. 3 is a perspective view of the armature of the prior art electrical switch construction of FIG. 1.

Referring now to FIGS. 1–3, a prior art electrical switch construction is generally indicated by the reference numeral 10 and will now be described in order to fully understand the improved latching features of this invention as illustrated in FIGS. 4–8 and hereinafter described.

The prior art electrical switch construction 10 in FIGS. 1–3 includes a frame means 11 carrying a pair of fixed switch blades 12 and 13 with a movable switch blade 14 disposed therebetween, the movable switch blade 14 having an electrical contact 15 carried adjacent the outer end 16 thereof for cooperating with an electrical contact 17 carried adjacent the outer end 18 of the fixed switch blade 12 when the movable switch blade 14 is held in the latched condition illustrated by full lines in FIG. 1 or for being placed into contact with an electrical contact 19 on the outer end 20 of the other fixed switch blade 13 when the latch means of the switch construction 10 that is generally indicated by the reference numeral 21 moves from the full line position illustrated in FIG. 1 to the unlatched condition illustrated by the dash-dotted lines in FIG. 1 so that the natural resiliency of the movable switch blade 14 will place the contact 15 thereof into contact with the contact 19 of the fixed blade 13 as illustrated by dash-dotted lines in FIG. 1.

The latch means 21 for the electric switch construction 10 includes an electrical coil 22 carried by a bracket member 23 having one portion 24 secured to the frame means 11 by a threaded fastening member 25 while another portion 26 of the bracket 23 passes through the coil 22 to provide the core therefor in a manner well known in the art and thereby attract a pivotally mounted armature 27 of the latch means 21 from the latched condition illustrated in full lines in FIG. 1 to the unlatched condition illustrated by dash-dotted lines in FIG. 1 when the electrical coil 22 is energized.

The armature 27 is best illustrated in FIG. 3 and has notches 28 formed therein to pivotally mount the armature 27 to an extension portion 29 of the bracket 23 as illustrated, the armature 27 having a bent end 30 and an opening 31 passing therethrough for receiving an end or lobe 32 of a cam 33 that is pivotally mounted to the frame means 11 by a shaft means 34.

The cam 33 has an abutment 35 which engages against the free end 16 of the movable switch blade 14 to force the movable switch blade 14 into the latched condition of FIG. 1 and thereby in contact with the fixed switch blade 12 in opposition to the force of the natural bias of the switch blade 14, the cam 33 being latched in such position because the end 32 of the cam 33 is received in the opening 31 of the armature 27 to thereby prevent counterclockwise movement of the cam 33 under the force of the switch blade 14.

In order to hold the armature 27 in the latching condition illustrated by full lines in FIG. 1, a leaf spring member 36 is provided, as best illustrated in FIG. 2, and has a pair of legs 37 carried by the frame 11 and a bent center leg 38 disposed against the end 39 of the armature 27 to tend to pivot the same in the counterclockwise direction of FIG. 1 to tend to hold the armature 27 in the latched condition illustrated by full lines in FIG. 1.

However, when the coil 22 is energized, the same electromagnetically attracts the armature 27 from the full line condition illustrated in FIG. 1 to the dash-dotted line condition illustrated in FIG. 1 whereby the opening 31 of the armature 27 is moved away from the end 32 of the cam 33 to permit the cam 33 to pivot in a counterclockwise direction under the force of the movable switch blade 14 whereby the movable switch blade 14 moves out of contact with the fixed switch blade 12 and into contact with the fixed switch blade 13. Thus, the movable switch blade 14 remains in the dash-dotted line position of FIG. 1 because even though the coil 22 is subsequently de-energized, the bent end 30 of the armature 27 is moved back against an angled surface 40 of the cam 33 by the spring 36 so that the cam 33 will not have the end 32 thereof enter the opening 31 and will remain in the dash-dotted line condition of FIG. 1 until manually reset by a movable plunger 41 carried by the frame means 11.

In particular, the movable plunger 41 has an abutment 42 engageable with an upper surface 43 of the cam 33 so that when the cam 33 is in the unlatched condition illustrated by dash-dotted lines in FIG. 1, downward movement of the button 41 causes the abutment 42 thereof to engage the surface 43 of the cam 33 and pivot the same in a clockwise direction from the condition illustrated in dash-dotted lines to the full line position of FIG. 1 whereby the angled surface 40 of the cam 33 cams against the bent end 30 of the armature 27 until the end 32 thereof can be received in the opening 31 of the armature 27. At this time, the force of the spring 36 pivots the armature 27 in a counterclockwise direction to fully receive the cam end 32 in the opening 31 whereby the cam 33 will again be latched in the full line position of FIG. 1 and the abutment 35 thereof will have moved the movable switch blade 14 out of contact with the fixed switch blade 13 and into contact with the fixed switch blade 12 as illustrated by full lines in FIG. 1.

As previously stated, it is a feature of this invention to provide improved latching means for an electrical switch construction, such as the prior art electrical switch construction 10 previously described.

Accordingly, reference is now made to FIGS. 5–8 wherein the improved electrical switch construction of this invention is generally indicated by the reference numeral 10A and parts thereof similar to the switch construction 10 previously described are indicated by like reference numerals followed by the reference letter "A."

Figure 4:
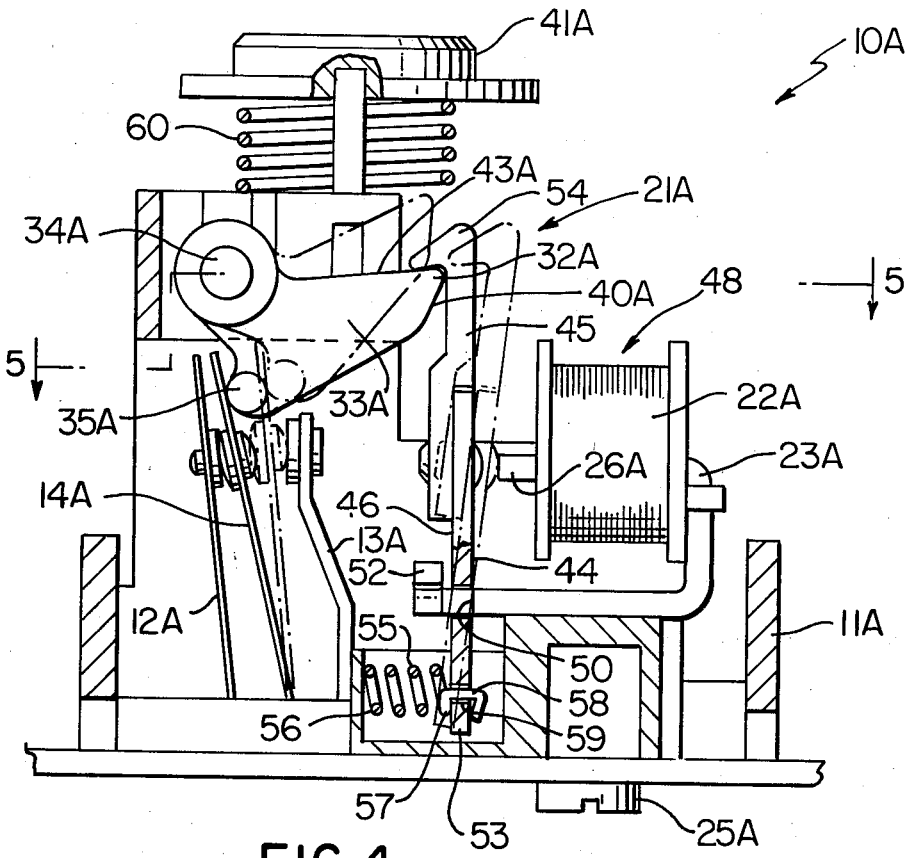
FIG. 4 is a view similar to FIG. 1 and illustrates the electrical switch construction of this invention.
Figure 5:
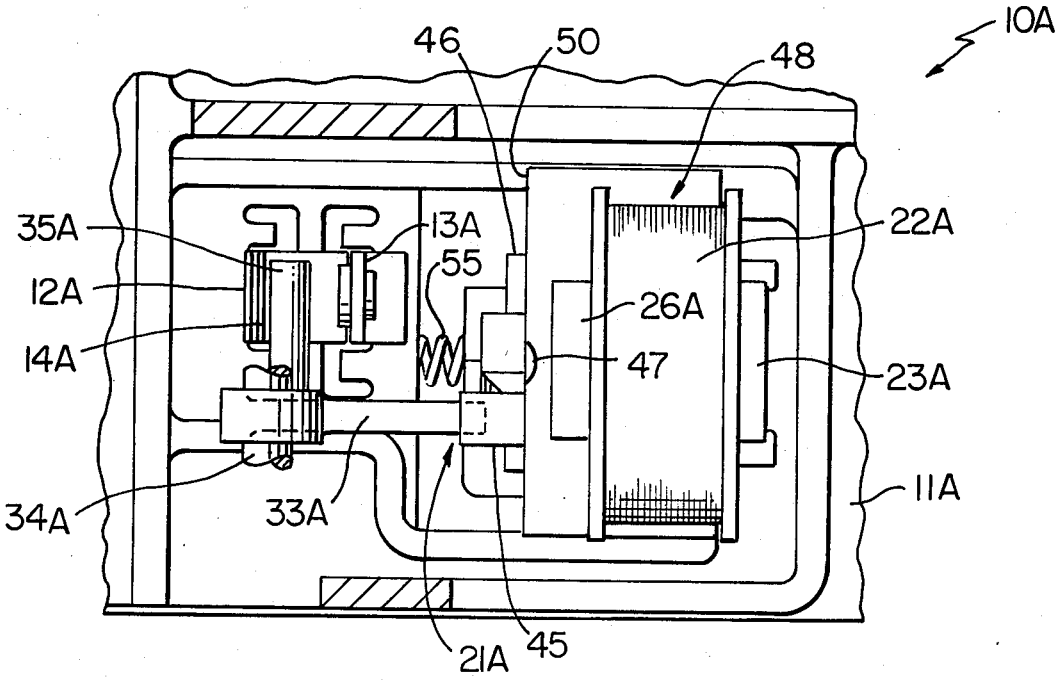
FIG. 5 is a fragmentary cross-sectional view taken on line 5—5 of FIG. 4.

As illustrated in FIGS. 4 and 5, it can be seen that the electrical switch construction 10A of this invention includes a frame means 11A carrying the fixed switch blades 12A and 13A and the movable switch blade 14A controlled by the rotatably mounted cam 33A that can be reset from the unlocked condition illustrated by dash-dotted lines in FIG. 4 by the resetting plunger 41A to the latched condition illustrated in full lines in FIG. 4.

However, the latch means 21A for the electrical switch construction 10A of this invention has been improved over the latch means 21 of the electrical switch construction 10 previously described.

In particular, the latch means 21A includes a pivotally mounted armature 44 that comprises two members 45 and 46 disposed and secured in overlapping relation by a fastening member, such as the rivet 47. The member 45 of the armature is formed of any suitable plastic material for a purpose hereinafter described while the member 46 of the armature 44 is formed of any suitable metallic material so as to be magnetically attracted by the electromagnetic actuator 48 that comprises the electrical coil 22A and core member 26A.

The core member 26A of the electromagnetic actuator 48 comprises part of the bracket 23A that is fastened to the frame 11A by the fastening means 25A.

Figure 6:
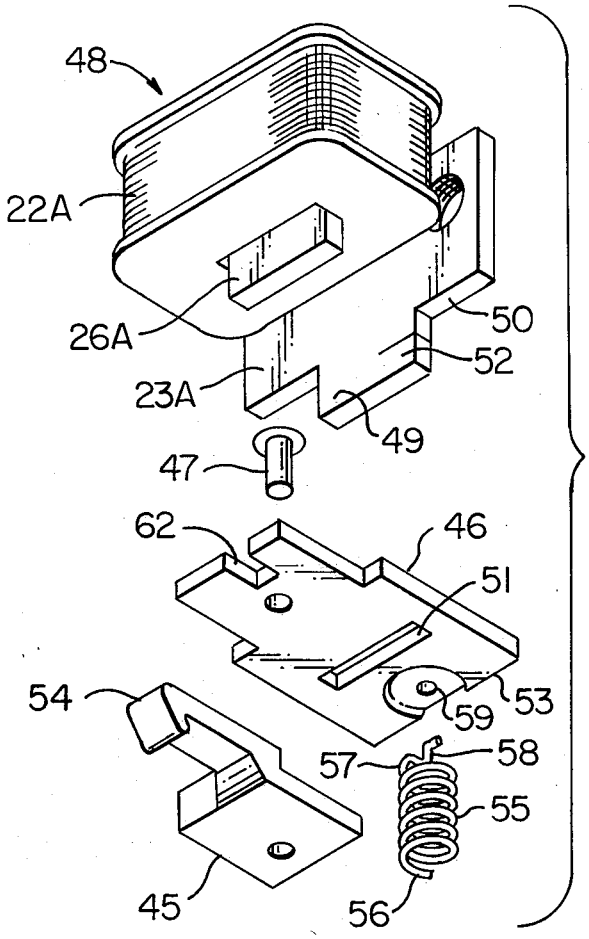
FIG. 6 is an exploded perspective view of the latching means of the electrical switch construction of this invention of FIG. 4.
Figure 7:
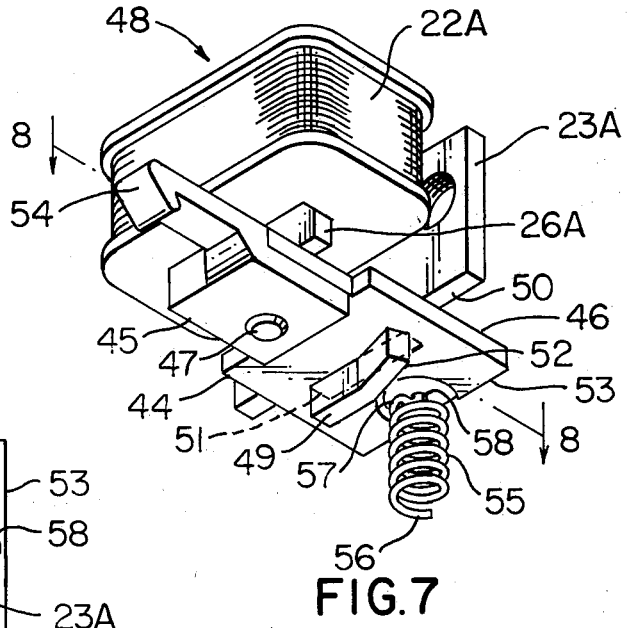
FIG. 7 is a view similar to FIG. 6 with the parts of FIG. 6 in their assembled condition.
Figure 8:
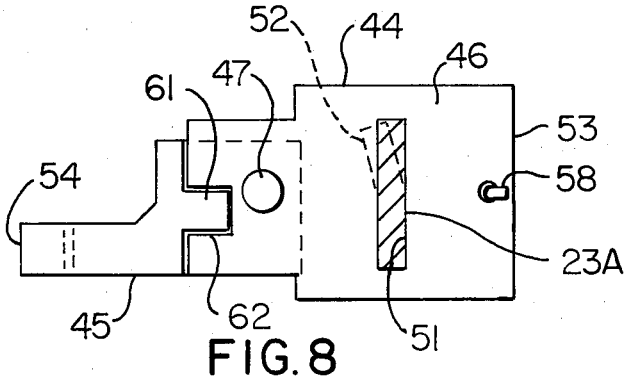
FIG. 8 is a cross-sectional view taken on line 8—8 of FIG. 7.

However, as illustrated in FIG. 6, the bracket 23A includes a depending tongue portion 49 that extends beyond a shoulder 50 thereof and is adapted to be received through a rectangular slot 51 formed through the armature part 46 whereby a split portion 52 of the tongue 49 can thereafter be bent at an angle as illustrated in FIGS. 7 and 8 to capture the armature 44 on the tongue 49 of the bracket 23A between the bent portion 52 of the tongue 49 and the shoulder 50 to thereby pivotally mount the armature 44 between its opposed ends 53 and 54 while being carried by the bracket 23A as illustrated.

A coiled compression spring 55 is carried by the frame means 11 and has one end 56 bearing against the frame means 11A while the other end 57 thereof bears against the end 53 of the armature 44 to tend to pivot the same in the latching counterclockwise direction of FIG. 4, the end 57 of the spring 55 having a projection 58 hooked through an opening 59 in the end 53 of the armature 44 to thereby be carried by the armature 44 in the manner illustrated in FIG. 7.

The armature part 45 that is formed of plastic material has an end 54 thereof formed in a hooked condition so that the same is adapted to hook over the end 22A of the cam 33A in the manner illustrated in FIG. 4 to latch the cam 33A in the illustrated full line condition thereof so that the movable switch blade 14A is latched and held in contact with the fixed switch blade 12A.

However, when the electromagnetic actuator 48 has the electrical coil 22A thereof energized, the same attracts the part 46 of the armature 44 toward the same whereby the armature 44 pivots in a clockwise direction from the full line position of FIG. 4 to the dash-dotted line position of FIG. 4 and thereby has the hook end 54 of the armature 44 unhooked from the end 32A of the cam 33A so that the cam 33A is moved from the full line position of FIG. 4 to the dash-dotted line position of FIG. 4 through the natural bias of the movable switch blade 14A whereby the movable switch blade 14A moves out of contact with the fixed switch blade 12A and into contact with the fixed switch blade 13A as illustrated by dash-dotted lines of FIG. 4.

When it is desired to manually reset the switch construction 10A from the dash-dotted line position illustrated in FIG. 4, the plunger 41A is moved downwardly in opposition to the force of a compression spring 60 that normally holds the reset member 41A outwardly so that the abutment thereof will act on the surface 43A of the cam member 33A and move the same clockwise back to the illustrated full line position so that the hook end 54 of the armature 44, under the force of the compression spring 55, will be cammed outwardly by the surface 40A until the hook end 54 passes beyond the end 32A of the cam 33A to permit the armature 44 to move to the full line position and thereby latch the cam 33A in the illustrated full line position where the movable switch blade 14A is held in contact with the fixed blade 12A as illustrated.

In order to prevent rotational movement of the armature members 45 and 46 relative to each other in their unlatched condition, the member 45 is provided with a spline portion or tongue 61 which is received in a spline notch 62 of member 46 to thereby spline the members together when the overlapping portions thereof are secured together by the fastening means 47 as previously described.

It is believed that the improved latch means 21A of this invention is more reliable and less costly than the latch means 21 of the prior art electrical switch construction 10 previously described.

For example, the leaf spring 36 has to be heat treated after fabrication which requires special handling and tooling whereas the compression spring 55 of this invention does not require any special handling.

Further, it can be seen that the bracket 23A of this invention is no longer required to capture the leaf spring 36 and it becomes much easier to manufacture.

Further, by providing the hook end 54 on the plastic member 45 of the armature 44 of this invention, the critical bend 30 in the armature member 27 has been eliminated and the armature 44 of this invention is now held in place by the bent portion 52 of the tongue 49 so that it becomes a permanent part of the assembly as illustrated in FIG. 7.

Also, upon making the armature 44 of the two members 45 and 46, it is possible to mass balance the armature 44 about its pivot line.

The action of the plastic member 45 to cam also reduces the coefficient friction between the armature 44 and cam 33A significantly to enable the assembly to actuate with less force from the actuator 48 and hence at a lower voltage.

In addition, it has been found that the compression spring 55 has a smoother action and forces the armature 44 against the lobe 32A of the cam 33A in substantially all tolerance situations which results in a more positive lock latch to the cam 33A.

The bracket 23A for the coil 22A is easier to fabricate and saves approximately 15% of the material necessary to produce the bracket 23.

Thus, it can be seen that the latch means 21A of this invention can be made in a relatively simple manner to provide the above features and to operate in a manner now to be described.

With the electrical switch construction 10A disposed in the latched condition illustrated in FIG. 4, it can be seen that the cam 33A holds the movable switch blade 14A against the normal bias thereof and in contact with the fixed switch blade 12A through the abutment 35A of the cam 33A, the cam 33A being held in the latched condition illustrated in full lines in FIG. 4 by the hooked end 54 of the armature 44 being disposed around the end 32A of the cam 33 and being held in such position by the force of the compression spring 55 tending to further pivot the armature 44 in a counterclockwise direction.

However, when the actuator 48 is actuated by having the coil 22A thereof energized, the same attracts the metallic part 46 of the armature 44 toward the same so that the armature 44 pivots in a clockwise direction in opposition to the force of the compression spring 55 to the illustrated dash-dotted line position where the end 54 is moved away from the lobe 32A of the cam 33A so that the cam 33A is forced in a counterclockwise direction about its pivot point 34A by the natural bias of the switch blade 14A moving away from the fixed switch blade 12A and into contact with the fixed switch blade 13A whereby the switch blade 14A remains in the dash-dotted line position of FIG. 4 until the latch means 21A is manually reset by the plunger 41A.

In particular, downward movement of the plunger 41A rotates the cam 33A in a clockwise direction from the dash-dotted line position of FIG. 4 to the full line position illustrated in FIG. 4 whereby the force of the compression spring 55 moves the hooking end 54 of the armature 44 back to the full line position to hook around the end 32A of the cam 33A and hold the cam 33A in the latch condition illustrated in FIG. 4 until the armature 44 is again actuated to the right by the actuator 48 in the manner previously described.

Therefore, it can be seen that this invention provides an electrical switch construction having improved latch means therefor or the like.

While the form of the invention now preferred has been illustrated and described as required by the Patent Statute, it is to be understood that other forms can be utilized and still fall within the scope of the appended claims.

What is claimed is:

1. In an electrical switch construction having a frame means carrying a movable switch blade and a latch means for latching said switch blade in one position when said latch means is latched and for causing said switch blade to be in another position when said latch means is unlatched, said latch means comprising an armature movably carried by said frame means and a cam movably carried by said frame means and being operatively associated with said switch blade to hold said switch blade in said one position thereof when said cam is latched by said armature being in a latching position thereof, said armature being moved to an unlatching position from said cam when said armature is actuated by an electromagnetic actuator carried by said frame means, the improvement wherein said armature comprises two members secured together, one of said members being formed of plastic material and having means for latching with said cam, the other of said members being formed of metal to be magnetically attracted by said actuator.

2. An electrical switch construction as set forth in claim 1 wherein said means of said one member of said armature comprises a hook portion of said one member.

3. An electrical switch construction as set forth in claim 1 wherein a spring is carried by said frame means and is operatively associated with said armature to tend to move said armature to its said latching position.

4. An electrical switch construction as set forth in claim 3 wherein said spring is a compression spring.

5. An electrical switch construction as set forth in claim 4 wherein said armature has opposed ends, said armature being pivotally mounted to said frame means intermediate said ends thereof, said compression spring being disposed between one of said ends of said armature and said frame means, the other of said ends of said armature having said means for latching with said cam.

6. An electrical switch construction as set forth in claim 5 wherein said frame means has a tongue, said other member of said armature having a slot therethrough and receiving said tongue to pivotally mount said armature to said frame means.

7. An electrical switch construction as set forth in claim 6 wherein said frame means includes a bracket carrying said actuator, said tongue being part of said bracket.

8. An electrical switch construction as set forth in claim 1 wherein said two members respectively have overlapping portions secured together in overlapping relation.

9. An electrical switch construction as set forth in claim 8 wherein said overlapping portions of said members are splined to each other.

10. In an electrical switch construction having a frame means carrying a movable switch blade and a latch means for latching said switch blade in one position when said latch means is latched and for causing said switch blade to be in another position when said latch means is unlatched, said latch means comprising an armature movably carried by said frame means and a cam movably carried by said frame means and being operatively associated with said switch blade to hold said switch blade in said one position thereof when said cam is latched by said armature being in a latching position thereof, said armature being moved to an unlatching position from said cam when said armature is actuated by an electromagnetic actuator carried by said frame means, the improvement wherein said armature has a slot passing therethrough, said frame means having a tongue passing through said slot to thereby pivotally mount said armature to said frame means.

11. An electrical switch construction as set forth in claim 10 wherein said tongue has a free end thereof projecting beyond said armature, said free end of said tongue being bent to capture said armature thereon.

12. An electrical switch construction as set forth in claim 11 wherein said actuator comprises an electrical coil, said frame means including a bracket that carries said coil, said tongue forming part of said bracket.

* * * * *